United States Patent [19]

Sampson et al.

[11] Patent Number: 4,995,208

[45] Date of Patent: Feb. 26, 1991

[54] SKYLIGHT CONSTRUCTION

[75] Inventors: Robert Sampson, Sanford; Sean Flanigan, Wells, both of Me.

[73] Assignee: Wasco Products, Inc., Sanford, Me.

[21] Appl. No.: 283,802

[22] Filed: Dec. 13, 1988

[51] Int. Cl.[5] ..... E04D 13/14

[52] U.S. Cl. ..... 52/200; 52/699

[58] Field of Search ..... 52/200, 72, 403, 397, 52/712, 714, 699; 49/485, 495, DIG. 1

[56] References Cited

U.S. PATENT DOCUMENTS

| | | | |
|---|---|---|---|
| 2,317,428 | 4/1943 | Anderson | 52/714 |
| 2,842,073 | 7/1958 | Huston et al. | 52/200 |
| 3,111,786 | 11/1963 | Wasserman | 52/200 |
| 3,139,702 | 7/1964 | Wasserman | 52/200 |
| 3,646,717 | 3/1972 | Parker | 52/712 |
| 4,449,340 | 5/1984 | Jentoft et al. | 52/200 |
| 4,473,979 | 10/1984 | Bruhm | 52/200 |
| 4,702,049 | 10/1987 | Sampson et al. | 52/200 |

*Primary Examiner*—Carl D. Friedman
*Assistant Examiner*—Caroline D. Dennison
*Attorney, Agent, or Firm*—Wolf, Greenfield & Sacks

[57] ABSTRACT

A skylight adapted to fit within the opening of a roof or the like having a peripheral curb frame which is fixed to the roof about the opening. The frame is constructed of a plastic material and includes a retainer for securing the skylight cover over the curb frame. A securing clip is employed for providing positive interlocking with the curb frame.

15 Claims, 3 Drawing Sheets

34
36
28
22
56
25
17
14
52
50
51
18
44
16
20
60
14
2
2
17
11B
56
22
40
11A
34
25
11
10
28
36

SKYLIGHT CONSTRUCTION

BACKGROUND OF THE INVENTION

1. Field of the Invention

The present invention relates in general to an improved skylight construction and is concerned, more particularly, with an improved skylight construction preferably formed of a coextruded plastic material, thus adapting itself to simplified manufacture and having improved temperature resistant and weathering properties. Even more particularly, the present invention pertains to an improved securing means for securing the skylight to a building.

2. Background Discussion

A skylight construction is shown, by way of example, in U.S. Pat. No. 4,449,340, granted May 22, 1984 and owned by the present assignee herein. This skylight construction is of plastic, including a frame that is comprised of a base frame and an operating leaf frame. A retainer that may be constructed of a lightweight metal material is typically employed for holding the glazing to the curb frame. Gasketing is typically provided between the glazing and the frame as well as between the frame components.

In U.S. Pat. No. 4,702,049, it is noted that a securing clip is employed for securing the skylight curb frame to the building. However, the securing clip, although engaging with the skylight curb frame, does not positively interlock therewith, and thus the securing clip may not be totally effective in the proper securing, as well as the positioning, of the skylight, particularly in proper orientation relative to the building opening.

Accordingly, it is an object of the present invention to provide an improved securing clip for use with a skylight and, in particular, with the skylight curb frame, and furthermore, in particular, with a skylight curb frame made of a plastic material such as PVC.

Another object of the present invention is to provide an improved securing clip that is adapted to engage with a lower channel in the curb frame and that is furthermore adapted to provide positive interlocking between the securing clip and the curb frame.

SUMMARY OF THE INVENTION

To accomplish the foregoing and other objects of this invention, there is provided a skylight construction adapted to be fitted into an opening in a building such as either a commercial building or a residential building. The skylight construction comprises a frame means that is of plastic construction, such as constructed of extruded PVC. The frame means or curb frame, extends about the opening and includes means for the securing thereof about the opening. The skylight construction also includes a translucent or transparent means covering the opening and extending at its edges to overlie the curb frame. The covering means may comprise one or more glazing panels, or may also be in the form of one or more plastic domes. A retainer extends about the periphery of the skylight for holding the glazing on the curb frame.

In the particular embodiment described herein, the curb frame is comprised of a base frame and an operating leaf frame overlying the base frame. However, the principles of the present invention may be employed in connection with either a single part or two-part curb frame. The curb frame is constructed of a rigid plastic profile having high temperature resistant properties and having integral therewith and coextruded therewith a flexible sealing flange.

In accordance with the present invention, an improved securing clip is provided that is adapted to provide a positive interlocking between the curb frame and the securing clip for proper positioning and securing of the skylight curb frame about the building opening. In this regard, the curb frame has a lower channel that receives the securing clip and in the lower channel there is defined in the curb frame a hook piece that engages with the channel in the securing clip so that once the securing clip is fully engaged in the curb frame channel then the securing clip is positively interlocked with the curb frame, thereby alleviating any positioning problems, and thereby ensuring that there will not be any slippage between the securing clip and the curb frame.

BRIEF DESCRIPTION OF THE DRAWINGS

Numerous other objects, features and advantages of the invention will now become apparent upon a reading of the following detailed description taken in conjunction with the accompanying drawings in which.

DETAILED DESCRIPTION

Figure 1:
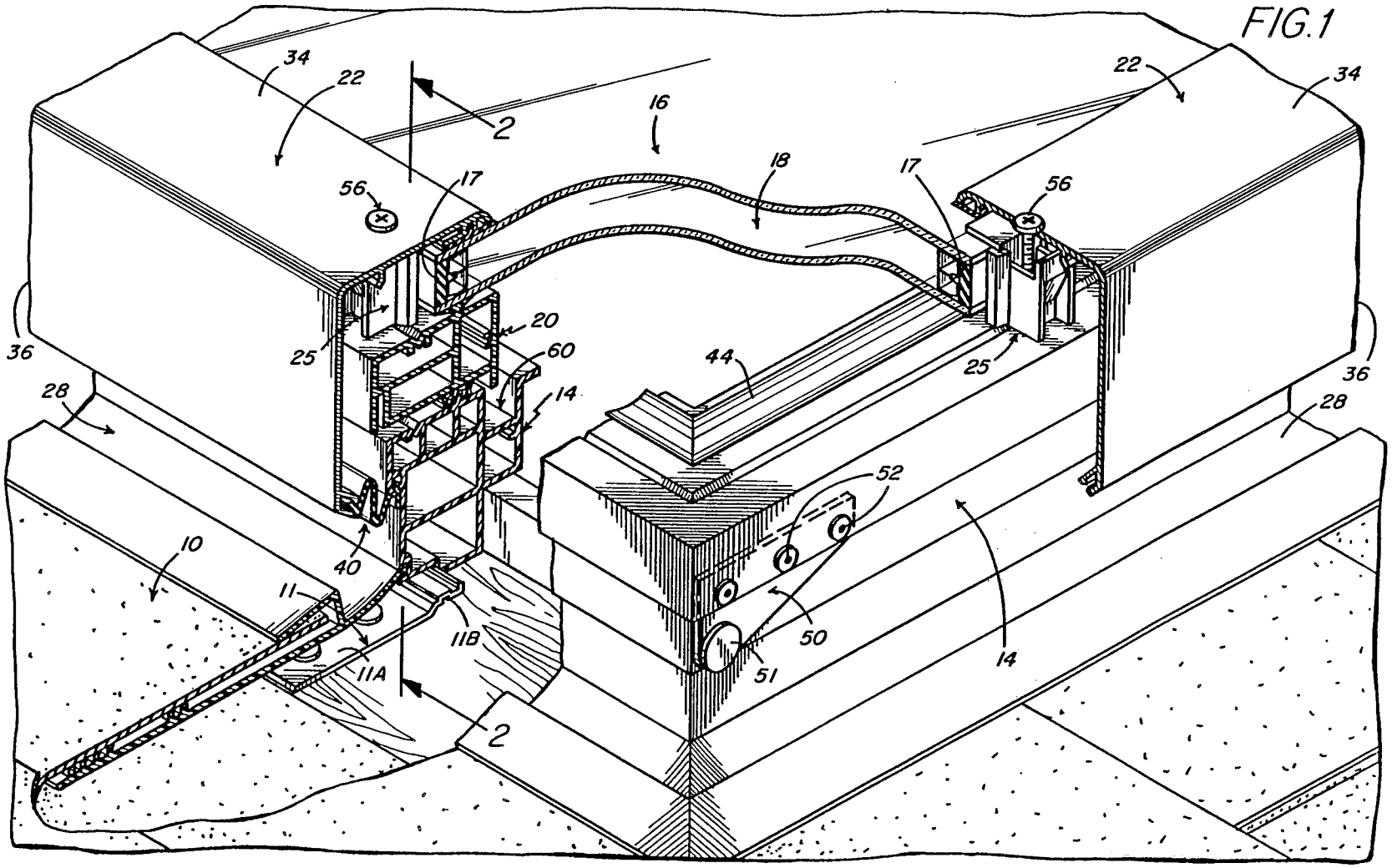
FIG. 1 is a perspective view, partially cut away, and illustrating a skylight construction in accordance with the present invention.
Figure 2:
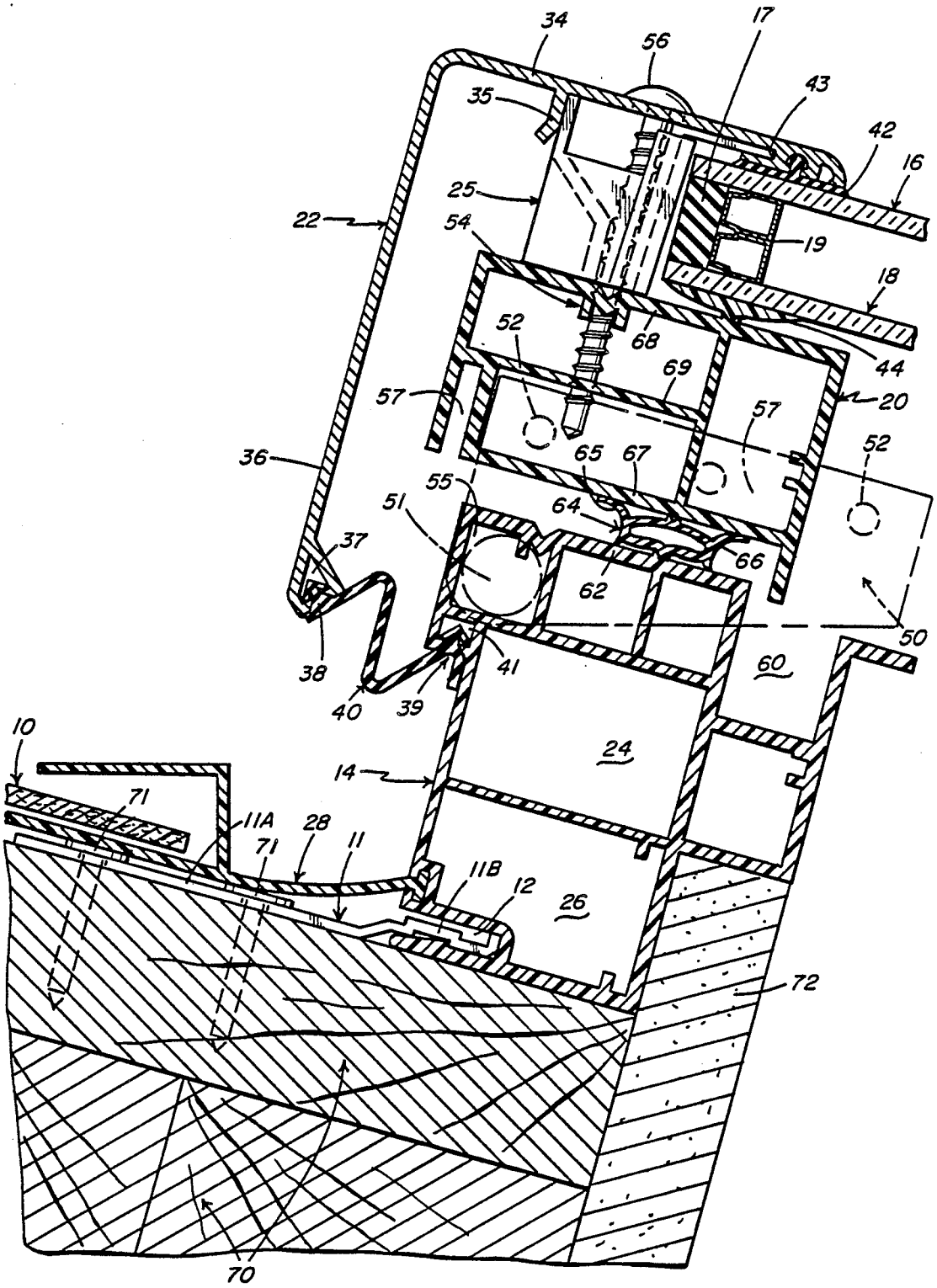
FIG. 2 is a cross-sectional view taken along line 2—2 of FIG. 1 and showing further cross-sectional details of the skylight construction.

Reference is no made to a skylight construction as illustrated in the cut-away perspective view of FIG. 1 and the cross-sectional view of FIG. 2. In the embodiment illustrated herein in FIGS. 1 and 2, the skylight is of a flat construction, having flat glazing panels. However, in alternate constructions, a domed type of skylight may also be employed. The skylight is adapted to span an opening which is generally of square or rectangular shape and the opening may be defined by upright walls or by headers within the roof construction.

The skylight described herein is characterized by improved energy performance; thermal air and weather tightness; simplicity of installation; good weathering properties; and enhanced durability.

The skylight construction shown herein includes a pair of glazing panels 16 and 18, a base frame 14, an operating leaf frame 20, and a retainer 22. The two frames 14 and 20 are constructed of a rigid PVC material and these frames are individually coextruded. The retainer 22 is preferably constructed of a lightweight metal material such as aluminum.

Each of the frames 14 and 20 is constructed by a coextrusion process in which a flexible gasket such as gasket 44 is coextruded with a rigid frame section. At the corner mitres, both the rigid and the flexible part of the frames are joined by a technique such as a heat platen sealing technique. This technique commonly joins the rigid frame sections at the corner mitres while at the same time joining the gaskets for providing a continuous seal about the entire skylight curb frame construction.

The base frame 14 may also be referred to as a fixed leaf, while the support frame 20 may also be referred to as the overlying operating leaf. The base frame 14 has internal compartments 24 and 26 and has associated therewith a peripheral sealing flange 28. As indicated, for example, in FIG. 2, the flange 28 interlocks with the base frame 14 and receives a piece of roofing such as the roofing shingle 10 illustrated in FIG. 2. Also refer to FIG. 1 for a clear showing of the manner in which the shingles 10 cooperatively interengage with the sealing flange 28. For further details on the construction and associated function of the sealing flange 28, refer to the assignee's U.S. Pat. No. 4,702,049, granted Oct. 27, 1987.

To secure the skylight, and in particular the base frame 14 thereof, in place on the roof, there are provided a plurality of securing clips 11, each having one end 11*a* for securing the clip to the roof construction and another end 11*b* received by the base frame 14 at the recess 12, as illustrated in FIG. 2. A series of these securing clips 11 may be disposed about all sides of the base frame 14. As illustrated in FIG. 2, the securing clip 11 at its end 11*a* is substantially flat and preferably has two holes for receiving roofing nails. The opposite end 11*b* of the securing clip 11 has a stepped construction to enable the securing clip to interlock in the recess 12 in the base frame 14.

The skylight glazing plates 16 and 18 are supported over the support frame 20 by means of the retainer 22. The plates 16 and 18 are supported by a glazing frame 19. On the outer periphery of the frame 19 between the plates 16 and 18 there is a gasket 17. The gasket 17 may be of a premolded butyl material. As illustrated in FIG. 2, the frame 19 may be comprised of separate metal spacers with an outer seal comprising a chemically curable two-part polysulfide.

The lower glazing plate 18 rests upon a cup shaped sealing gasket 44 which is coextruded with the support frame 20. In FIG. 2, the gasket 44 is shown in its compressed position. The operating leaf or support frame 20 also includes means defining a channel 54 for receiving a securing bolt 56. The channel 54 is preferably threaded to receive the bolt 56. There are actually a plurality of these securing bolts or screws that are employed for securing the retainer 22 over the glazing plates 16 and 18. Two of the securing bolts 56 are shown in the perspective view of FIG. 1, each having associated therewith a cushion member 25. The securing bolt 56 actually passes through the glazing securing member 25, forming a cushioning for the edges of the glazing plates to prevent damage thereto, as well as to facilitate positioning thereof.

The retainer 22 has a top leg 34 and a side leg 36. The retainer 22 is generally of L shaped construction. At the bottom end of leg 36 there is provided a pair of walls defining an interlocking channel 37 for receiving one end 38 of the header gasket 40. The other end 39 of the header gasket 40 is received within an interlocking channel 41 formed in the base frame 14. In FIG. 2 the header gasket 40 is shown in the closed position of the skylight with the header gasket thus in its more elongated form.

The top leg 34 of the retainer 22 is also adapted to receive a gasket, illustrated in FIG. 2 as the relatively flat gasket 42 that is interlocked with the very free end of the leg 34. The gasket 42 may be constructed of a premolded butyl material and is adapted to engage with and securely hold the top of the glazing plates, contacting the plate 16 as illustrated in FIG. 2. The top leg 34 also has a depending wall 35 for engagement by the glazing cushion member 25. The leg 34 also includes a slot 43 for receiving a leg of the glass cushion member 25.

As indicated previously, the particular skylight construction depicted herein is in the form of a two-part curb frame with a base frame added overlying the operating frame. For the purpose of opening the operating frame, there are provided hinges 50, one on either side of the skylight. The cut away perspective view of FIG. 1 shows the hinge 50 having associated therewith a pivot pin 51 and rivets 52. FIG. 2 also shows, in dotted outline, the hinge 50 and the placement of the pop rivets at 52. FIG. 2 also shows, in dotted outline, the pivot pin 51. The pin 51 is adapted to be retained in the channel 55 of the base frame 14. The overlying leaf frame 20 has a peripherally disposed channel 57 and along the sides thereof, the hinge 50 is pop riveted to the frame 20 while the hinge 50 is maintained in this channel 57.

Regarding the base frame 14, as indicated previously, it includes compartments 24 and 26, recess 12 for receiving the securing clip 11, and channels for receiving the pivot pin 51 and the header gasket 40. The base frame 14 also is provided with a condensation gutter 60 and furthermore supports at its top wall 62 the gasket 64. The gasket 64 is constructed to provide multiple sealing points. The gasket 64 is generally of cylindrical construction but is provided with separately disposed ears such as the ears 65 and 66 illustrated in FIG. 2. FIG. 2 clearly illustrates the multiple sealing points of the gasket 64. It is also noted that multiple sealing points are provided not only at the wall 62 but also at the wall 67 of the overlying leaf frame 20. In FIG. 2 the gasket 64 is shown in partially compressed position and providing an effective watertight seal between the separate curb frame sections.

Reference has been made hereinbefore to the bolt 56 as it relates to securing the retainer to the curb frame. As noted in FIG. 2, the bolt 56 preferably passes not only through the threaded channel 54 in wall 68 of the frame 20, but also through the wall 69. In other words, the securing bolt 56 actually penetrates two walls of the frame 20. This adds further stability to the overall skylight construction, particularly as it relates to the retaining of the glazings.

FIG. 2 shows a part of the building construction, including building members 70, which may be of wood construction such as typical 2 x 4s or 2 x 6s. FIG. 2 shows the roofing nails 71 used through the securing clip 11 and driven into the members 70. There is also illustrated in FIG. 2 a gypsum board 72 associated with the base frame 14. This is a typical building construction that can be used and that is associated with the skylight.

Figure 3:
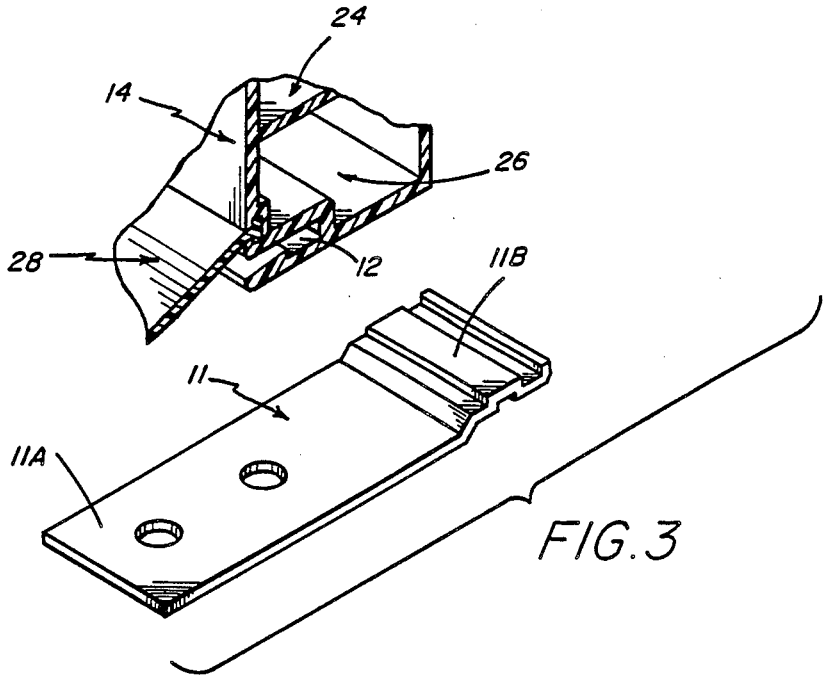
FIG 3 is a fragmentary perspective view illustrating the securing clip and a section of the curb frame.
Figure 4:
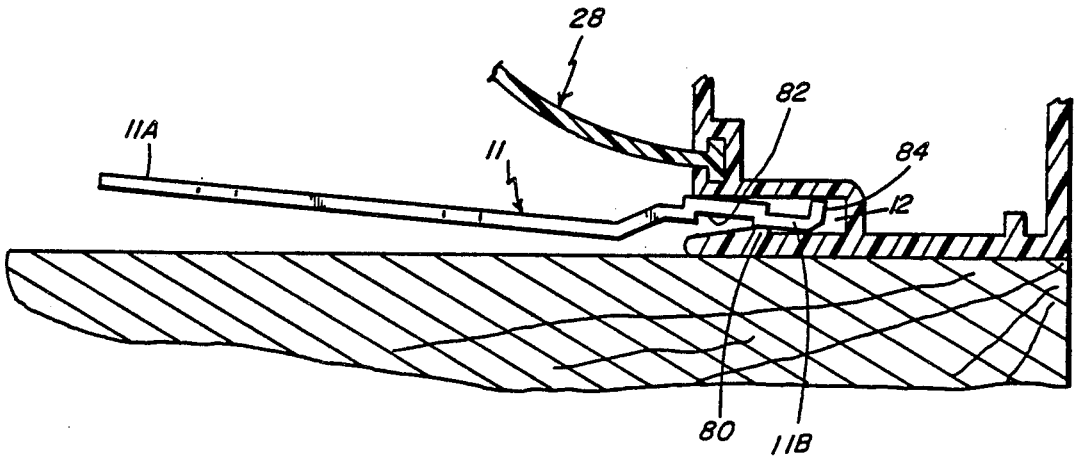
FIG. 4 is a fragmentary cross-sectional view of the curb frame at a securing clip and illustrating the position of the securing clip as it is partially inserted into the accommodating curb frame channel.

Reference is now made to FIGS. 3 and 4 herein for further details of the securing clip as constructed in accordance with the present invention. In this regard, FIG. 3 is a fragmentary perspective and exploded view illustrating a section of the curb frame and the securing clip. FIG. 4 is a fragmentary cross-sectional view illustrating the securing clip partially inserted into the channel or recess in the curb frame, which is adapted to receive the securing clip. It is noted in the view of FIG. 4 that the flexible sealing flange has been lifted so as to enable insertion of the securing clip 11. FIG. 4 has been shown to illustrate the manner in which the securing clip is inserted by tilting and then once it is in position the securing clip engages with a hook member in the recess.

As indicated previously, a plurality of securing clips 11, each having one end 11A for securing the clip to the roof construction, and another end 11B received by the base frame 14 at the recess 12, are disposed at different predetermined positions about the skylight. In this regard, refer to FIGS. 1 and 2, which show the positioning of the securing clip. As illustrated in FIG. 2, the securing clip at its end 11A is substantially flat and preferably has two holes for receiving roofing nails. In this regard, note the roofing nails 71 in FIG. 2. The opposite end 11B of the securing clip 11 has a stepped construction to enable the clip to interlock in the recess 12 and the base frame 14.

FIGS. 3 and 4 show further details of the securing clip, particularly at the end 11B. As indicated previously, there is a stepped construction defining a channel 82 and, furthermore, having an end wall 84 that is adapted to engage at the very bottom end of the recess 12. In this regard, FIG. 2 shows the clip fully in position and nailed down while FIG. 4 shows the securing clip partially inserted with the end wall 84 not yet fully into position and with the securing clip not yet interlocked with the recess in the curb frame.

For the purpose of interlocking of the securing clip, the recess 12 is provided with a hook segment 80 in which the entrance to the recess 12 is essentially ramped to define this hook segment. In FIG. 4, the securing clip is shown partially inserted with the channel 82 not yet engaged with the hook segment 80. As the securing clip is moved fully into the recess 12, then the securing clip may be moved downwardly at its end 11A so that the channel 82 engages at one side thereof with the hook member 80 as clearly illustrated in, for example, FIG. 2. As long as the end 11A of the securing clip 11 is not tilted upwardly, the securing clip at end 11B is maintained interlocked with the recess 12. Once the roofing nails 71 are secured through the end 11A of the securing clip 11 then there is a complete positive interlocking between the securing clip and the curb frame.

In connection with the installation of the securing clips, it is noted in FIG. 4 that the flexible flange 28 may be lifted so as to provide sufficient room for insertion of the securing clips. The securing clip is inserted at a slightly tilted angle, such as illustrated in FIG. 4, but then is rotated once it is fully engaged and fully in the recess 12, to a substantially horizontal position, such as the position illustrated in FIG. 2.

Having now described a limited number of embodiments of the present invention, it should now become apparent to those skilled in the art that numerous other embodiments and modifications are contemplated as falling within the scope of the present invention, as defined by the appended claims.

What is claimed is:

1. A skylight construction for an opening in a building or the like comprising: a frame means extending about the opening and including means securable about the opening, translucent or transparent means covering the opening and extending at edges to overlie the frame means, means for retaining the covering means on the frame means, said means securable about the opening comprising a securing clip adapted to be received in a recess of the frame means and having means for providing positive interlocking with the frame means, as well as means for attachment to the building, said means for providing positive interlocking comprising means defining a channel in said securing clip, said frame means having a hook segment extending into the recess of the frame means, wherein said securing clip, in a first position, is disposed with its end extending into the recess beyond said hook segment, and, in a second position, is disposed so that the hook segment engages in edge defining said channel so as to interlock the securing clip and frame means.

2. A skylight construction as set forth in claim 1, including a gasket extending from the frame means and disposed between the frame means and the covering means.

3. A skylight construction as set forth in claim 1 wherein said frame means comprises a base frame and an overlying support frame, and further including hinges between the base frame and the support frame.

4. A skylight construction as set forth in claim 1 wherein said covering means includes at least one plate means.

5. A skylight construction as set forth in claim 4 wherein said covering means includes a pair of glazing plates.

6. A skylight construction as set forth in claim 1 wherein said retaining means includes a retainer having one side extending downwardly toward the frame means and another side extending inwardly to contact the edge of the covering means.

7. A skylight construction as set forth in claim 1 including a cup-shaped gasket carried by the frame means and upon which the covering means rests.

8. A skylight construction as set forth in claim 1 wherein said securing clip has an upright end wall adapted to engage in a bottom of the frame means recess.

9. A skylight construction as set forth in claim 8 wherein the distance from the securing clip end wall to the closest edge defining the channel therein is comparable to the distance from the bottom of the frame recess to the hook member.

10. A skylight construction as set forth in claim 9 wherein the securing clip is inserted by tilting until the channel reaches the hook member, whereby the securing clip is then moved downwardly so that the channel member interengages and interlocks with the hook member.

11. A skylight construction for an opening in a building or the like comprising: a frame means extending about the opening and including means securable about the opening, translucent or transparent means covering the opening and extending at edges to overlie the frame means, means for retaining the covering means on the frame means, said frame means comprising a curb frame, said means for retaining comprising a retainer, said means for securing the curb frame about the opening comprising a recess defined in the bottom of the curb frame, in combination with, a securing clip having positive interlocking means for engaging with the recess in the curb frame and limiting lateral movement of the securing clip relative to the curb frame, said positive interlocking means having means defining a channel in the securing clip, said channel being disposed in an underside surface of said securing clip and having at least one engaging edge, said frame means having a hook segment extending upwardly and into said frame means recess and for engagement by said channel edge so as to inhibit said securing clip lateral movement.

12. A skylight construction as set forth in claim 11 wherein said securing clip has an upright end wall adapted to engage in the bottom of the frame means recess.

13. A skylight construction as set forth in claim 11 wherein the distance from the securing clip end wall to the closest edge defining the channel therein is comparable to the distance from the bottom of the frame recess to the hook member.

14. A skylight construction for an opening in a building or the like comprising: a frame means extending about the opening and including means securable about the opening, translucent or transparent means covering the opening and extending at edges to overlie the frame means, means for retaining the covering means on the frame means, said frame means comprising a curb frame, said means for retaining comprising a retainer, said means for securing the curb frame about the opening comprising a securing clip having positive interlocking means for engaging with the curb frame and means for attachment of the securing clip to the building, said means for attachment being disposed under the flashing associated with the skylight construction, wherein the positive interlocking between the securing clip and the frame means is provided by a channel in the securing clip adapted to engage against a hook segment extending into the recess of the frame means, said securing clip having an end wall adapted to engage in the bottom of the frame means recess, the distance from the securing clip end wall to the closest edge defining the channel therein being comparable to the distance from the bottom of the frame means recess to the hook member.

15. A skylight construction as set forth in claim 14 wherein said channel is disposed in an underside surface of said securing clip and said hook member extends upwardly into said frame means recess.

* * * * *